United States Patent [19]

Bibbey et al.

[11] Patent Number: 5,062,643

[45] Date of Patent: Nov. 5, 1991

[54] GOLFING AID

[76] Inventors: Carter S. Bibbey, 2508 Wildrose Ct.; Jack L. Williams, 2405 Castle Rock Rd, both of Arlington, Tex. 76006

[21] Appl. No.: 650,745

[22] Filed: Feb. 5, 1991

[51] Int. Cl.[5] ..... A63B 69/36

[52] U.S. Cl. ..... 273/188 A; 273/26 R; 273/187 R; 272/145

[58] Field of Search ..... 273/188 R, 188 A, 189 R, 273/190 R, 190 A, 190 B, 32 C, 32 R, 32 B, 32 H, 183 B, 26 R, 195 R, 187 R; 272/96, 145

[56] References Cited

U.S. PATENT DOCUMENTS

| | | | |
|---|---|---|---|
| 771,938 | 10/1904 | Ruhl | 272/96 |
| 2,250,493 | 7/1941 | Milne | 272/96 |
| 2,711,320 | 6/1955 | Clark | 273/188 R |
| 3,350,096 | 10/1967 | Kile et al. | 273/188 R X |
| 3,372,930 | 3/1968 | Sertich | 273/26 R |
| 3,606,341 | 9/1971 | Honbarger | 272/96 X |
| 3,951,407 | 4/1976 | Calacurcio | 273/188 A X |
| 4,306,714 | 12/1981 | Loomis et al. | 272/96 |
| 4,657,258 | 4/1987 | Melov | 273/187 R |

*Primary Examiner*—George J. Marlo

*Attorney, Agent, or Firm*—Hubbard, Thurman, Tucker & Harris

[57] ABSTRACT

A portable golfing aid conditions the golfer to swing on a constant arc by limiting and restraining the pivot foot from lifting or pivoting. Base members which are spaced a shoe width apart are removably secured with respect to the ground or mounted on a pad or mat. Slotted portions of the base members receive a removable adjustable strap which connects the base members and bridges the front instep portion of the golfer's shoe and may be angled snugly across the instep. The golfing aid may be equipped with foldable ground engaging legs and when folded collapses to fit in a pocket in a golf bag. A less portable mat-mounted device is provided with pivoting adjustability for an angulated foot position.

28 Claims, 3 Drawing Sheets

GOLFING AID

BACKGROUND OF THE INVENTION

1. Field of the Invention

The invention relates to a device used to condition the golfer's body position, more particularly, his stance to improve the consistency of the swing.

2. Background of the Prior Art

There are many methods of teaching the game of golf which emphasize various aspects of addressing and striking the ball, body position, position of the head, grip, stance and many other aspects which affect the golfer's ability to address and strike the ball with accuracy and consistency. Although various teachers emphasize different aspects, and perhaps differences based upon the particular club or shot, most emphasize the need to achieve a consistent and reproduceable backswing and follow through which will be collectively referred to as the swing.

Despite the numerous methods and variety of teaching devices available today, it is indeed difficult to remember all the important attributes which contribute to the development of a consistent golf swing. Even the most experienced golfer's frequently go into a "slump" where they are unable to reproduce any consistency with the golf swing depite previous abilities. Or, they may have good swings intermixed with swings that are extremely unpredictable. Illustrating the complexity of the problem, this even happens to the professionals.

Having personally experienced this difficulty, we have analyzed the problem and both invented a device which is usable at a practice area or driving range to significantly improve the consistency of the golf swing. We have discovered that a poor golf swing most frequently occurs when a golfer rotates the foot or lifts the heel of the pivotal leg more than about a half inch. The pivotal leg is the left leg of a right handed golfer and the right leg of a left handed golfer. The device is secured to the ground, or other permanent surface, and anchors the foot of the pivotal leg to teach the golfer to keep the foot firmly planted. With repetitive practice, the golfer is unconciously conditioned to keep the pivotal foot and leg firmly planted during the golf swing.

SUMMARY OF THE INVENTION

The teaching device restricts and restrains the golfer's pivotal foot from undesirable movement during the entire golf swing, thus enabling the golfer to maintain balance while consistently controlling upper body movement to maximize power through the golf swing.

An outside base member having front and rear end portions and a contact surface between the end portions for contact with the outside edge of the golfer's shoe is spaced apart from an inside base member having front and rear end portions and a contact surface between the end portions for contact with the inside edge part of the golfer's shoe. The inside and outside base members are provided with a means for positioning them on a surface, in spaced apart parallel orientation, a golf shoe width apart.

In one embodiment, the end portions of the base members are provided with foldable legs which may be secured by wing nuts in perpendicular orientation and the legs may be pressed into the ground so that the base members are situated on the surface of the ground.

In another embodiment, the base members may be mounted to a pad which may be secured by spikes to keep it from moving. In yet another embodiment, the base members may be mounted on a mat in spaced apart orientation, the mat preferably having a rubber tee of the type commonly seen on driving ranges.

Preferably, the outside base member is considerably longer than the inside base member to minimize interference with the slight rolling action of the foot which necessarily occurs, for example, when a right handed golfer transfers weight to the right foot during the backswing.

The base members are elongated bars having connected between them, a connecting device which is bridgeable over the front portion of the golfer's shoe when the shoe is placed between the base members in use position, the connecting device connecting a front portion of the outside base member with the inside base member. The connecting device is preferably an adjustable strap of sufficient length to bridge the instep of different sized golf shoes and permit variation in the lateral spacing of the base members so as to accommodate shoes of different width.

At least one of the base members has a slotted portion for connecting the strap by looping the strap through the slot in the base member. The slotted portion may be integrally formed in the body of the base member, or both members, or it may be formed by separately attaching a strap support to each of the base members. A particularly effective strap is a VELCRO strap which is fixedly looped around one of the base members and adjustably looped through the other slotted area and folded over to be quickly and easily tightened over the foot and easily releasable for removing the foot or for transporting and storing the device. With the foldable legs, the entire device is easily folded with the strap wrapped around for carrying in the golf bag. Alternately, the strap can be a belt-like strap which is looped through the slotted portion of each base member and buckled. Still further, a flexible, extensible rubber strap may be used which may be fixedly attached to the two base members or have an adjustable length feature by means of a keeper.

Base members may be mounted on a mat of sufficient size to accommodate a golfer and a normally located tee, with the base members being located offset and to the rear of the center of the mat to accommodate the stance. An outside base member is mounted close to one edge of the mat with the inside base member mounted on the mat a golf shoe width away from the outside base member. The base members have a connecting device mounted over them and adjustably fixed to bridge and restrain the front portion of the golfer's shoe when it is placed between the base members in position for use. Preferably, the base members are adjustably mounted on the mat by means of a pivotal connection at the rear end closer to the heel. The opposite front end being adjustably mounted by means of fasteners which cooperate with the mat nearer to the toe. Fasteners with wing nuts and a radially arranged line of grommets may be used to adjust the position of the front end of the base members, which allows for some angling of the foot with respect to the line of flight of the ball to accommodate the golfer's individual preference. The base members have slotted portions, as before, which accommodate an adjustable connecting device or strap to snug over the front of the golfer's shoe. The outside base member preferably has a slotted portion considerably longer than the width of the strap which permits biasing the strap at an angle over the instep from the longitudinal axis of the foot. This permits the user to get a good, snug fit of the strap over the shoe.

An alternate embodiment has spaced apart inside and outside base members which have a connecting device which extends forward of the front ends of the base members in a raised toe receiving portion which has a downwardly curved surface for retaining the shoe in a toe receiving cavity wherein the base members are connected through the curved surface and extend rearwardly of the toe receiving cavity in spaced apart parallel relation. Each of the base members include a means for removably securing the base member to a ground surface. The securing means may include openings for cooperating spikes or have foldable legs of the type previously mentioned.

DETAILED DESCRIPTION OF THE INVENTION

Figure 1:
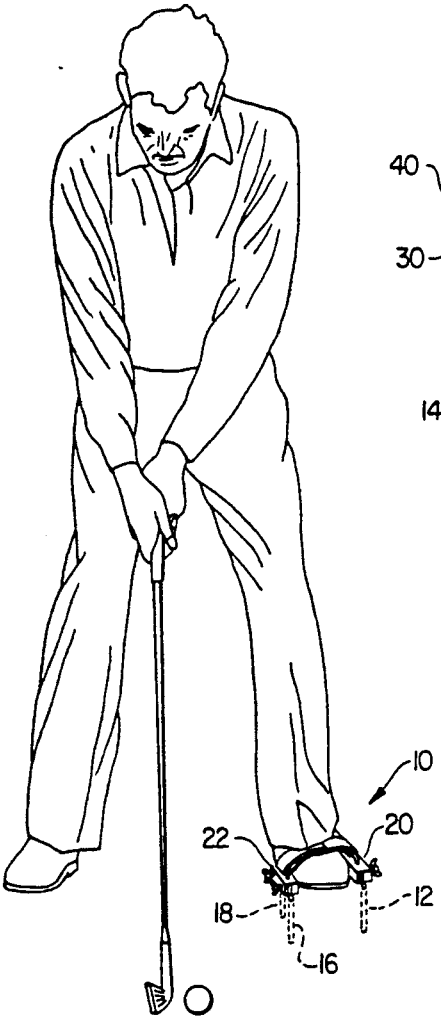
FIG. 1 is a perspective of a right-handed golfer addressing the ball with an embodiment of the invention in place in the ground.

In the description that follows, like elements will be referred to by the same reference numerals insofar as possible.

In FIG. 1, the golf aid is referred to generally by the reference number 10. It shows the structure of FIG. 2 mounted on the ground so that the golfer shown can repetitively practice his swing. Foldable leg 12 of outside base 20 and foldable legs 16, 18 of inside base member 22 are seen in dotted lines in FIG. 1, which indicates that they are removably inserted into the ground. Outside and inside base members 20, 22 are elongated bars which are shown having a rectangular cross-section.

The base members are shown in spaced apart parallel relation with outside bar 20 having an outside edge contact surface 24 for contacting the outside edge part of a golfer's shoe. Inside base member 22 similarly has an inside edge contact surface for contacting the inside edge part of a golfer's shoe. In this context, outside or inside refers to the outside or inside of a golfer's shoe and the outside base member is located closer to the final destination of the ball after the golfer hits it.

Figure 3:
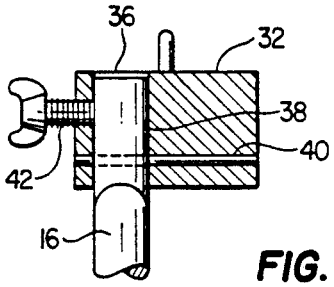
FIG. 3 is a cutaway cross-section showing a detail of a folding leg.
Figure 4:
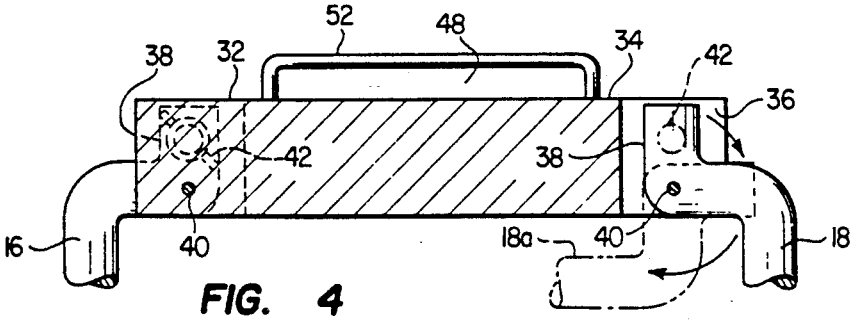
FIG. 4 is another cutaway cross-section of FIG. 2 showing the folding legs.

Outside base member 20 has a front end portion 28 and a rear or back end portion 30 which again refers to the toe or heel respectively of the golfer's foot. Similarly, inside base member 22 has a front end portion 32 and a rear end portion 34. Each of the front and rear end portions of the base member are slotted to contain the foldable leg members 12, 14, 16, and 18 which are rotatably pinned in the slot 36 as indicated by FIGS. 3 and 4. FIG. 3 which shows foldable legs 16, 18 is representative. An offset leg end portion 38 at the end of the leg 16 is pinned through the end portion of the base member by a pin member 40. The legs are actually identically constructed so that the offset end of leg 18 is also referred to by the reference numeral 38 and held by a pin 40 for folding rotation thereabout as seen in FIG. 4. Reference numeral **18*a* in phantom shows how leg 18**, or any of the legs, are folded under the base member to lie along the bottom surface thereof.

Note that the notches 36, especially on the shorter inside base member, are laterally offset so that the foldable legs don't interfere when they are folded up against the bottom surface of the base member. The same is true with the legs of the outside base member, but it may be long enough so that interference between the legs does not occur when they are folded.

Finally, a thumb screw 42 is threaded through the end portion of each base member to frictionally engage the offset leg portion 38 of the leg member and hold it in an extended ground-engaging position. This helps make it easier to push the legs on a base member into the ground with the foot. When the legs are pushed into the ground, the bottom surface of the base members naturally rest on the surface of the ground and are removably secured in use position a shoe width apart.

The base members are placed in parallel spaced apart relation as previously mentioned. A connecting device 44 is bridgeable over the front portion of the golfer's shoe when the shoe is placed between the spaced apart inside and outside base members 20, 22 proximate the end portions 28, 32. Each of the base members has a slotted part.

Figure 2:
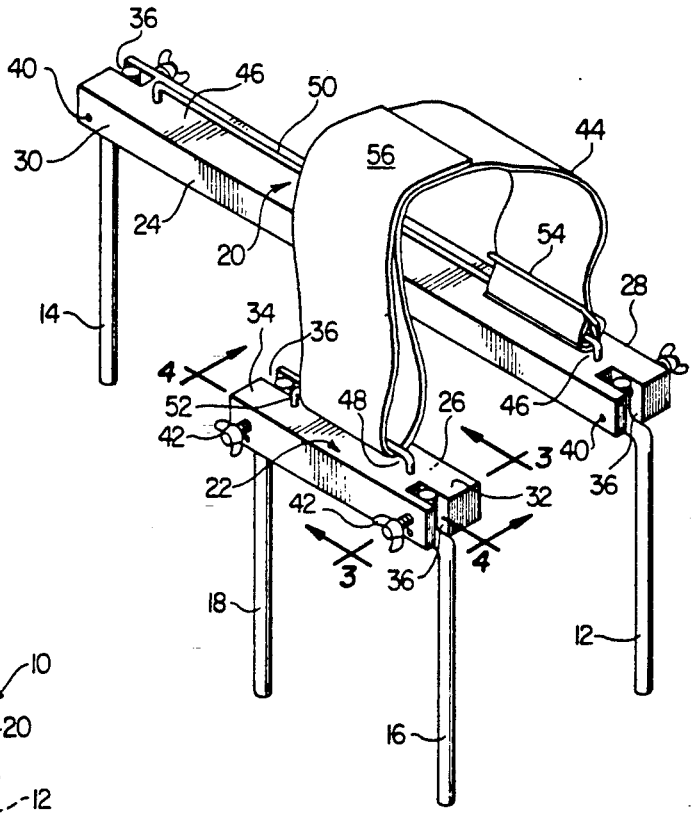
FIG. 2 is a perspective view of an embodiment of the invention having folding, ground-engaging legs and an adjustable strap.
Figure 7:
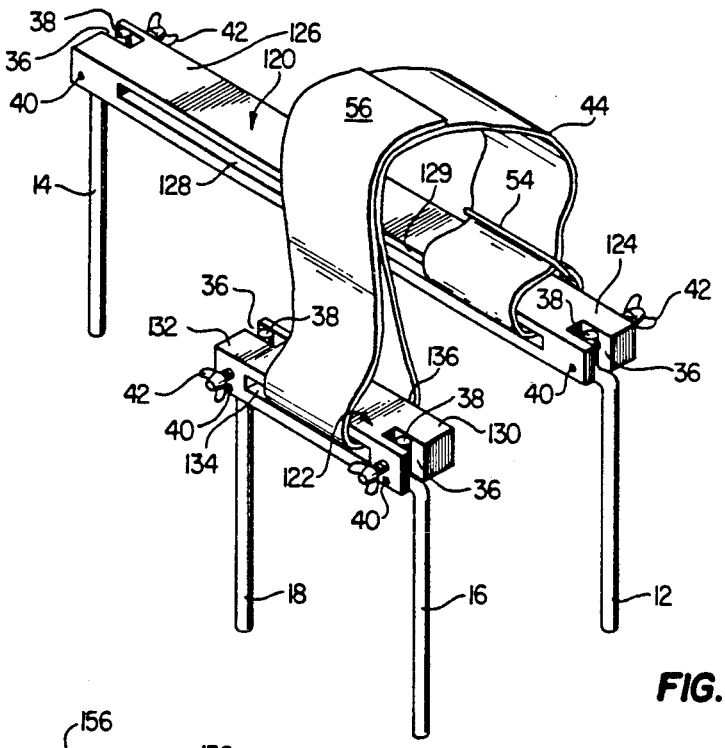
FIG. 7 is a perspective view of the embodiment of FIG. 2 having integrally formed slotted portions for an adjustable strap.

Outside base member 20 has a slot 46 for receiving the strap, while inside base member 22 has a slot 48 for receiving a portion of the strap. The slot may be formed by separately attaching the strap supports 50, 52 to the outside and inside base members respectively. This is shown in FIG. 2. Alternately, the slotted portions may be integrally formed in the body of the base members as shown in FIG. 7. The connecting device 44 is preferably a thin VELCRO strap which has a captured retainer with the end looped through and around the strap support 50 in FIG. 2. The free end 56 is placed through the slot 48 on the inside base member and around the support 52 and the end overlapped to be adjustably and releasably held by the VELCRO material so that it passes over the instep or front portion of the golfer's shoe when it is placed between the inside and outside base members as in FIGS. 1 and 2.

The connecting device 44 is quickly and snugly arranged over the golfer's shoe to provide the necessary restraint. Looped portions of the strap connect the base members and the strap may be adjusted to tighten or loosen it. The free end 56 of the strap is seen in FIG. 2 lying on top so that it can be reached. When the slotted portion 46 formed by the strap support 50 extends almost the whole length of the elongated outside base member between the end portions 28, 30, the looped end of the strap opposite end 56 is free to slide there-along. Since the slotted portion and strap support is longer than the width of the strap, it permits locating the strap across the instep of a golfer's shoe angled from the perpendicular to the longitudinal axis of the foot. When tightened in this position, it will stay in this position and provides a snug, more comfortable restraint.

Another aspect of this feature is that the strap which is looped around the strap support 50 (or integral slot) may be slid from the front end 28 to the rear end 30 for use by a left-handed golfer in essentially a mirror imaged relation from that of FIG. 1. It must be realized that a left-handed golfer would appear as a mirror image of FIG. 1, but the golf aid device would position the left-handed golfer's right foot instead of the left foot. For this application, the rear end portions 34 and 30 of the inside and outside base members would be placed across from each other and the retained end of the connecting device 44 slid to the opposite end of the outside base member from the position shown in FIG. 2. It might be said that the strap is fixedly looped around the strap support of the outside base member and adjustably looped around the strap support of the inside base member.

Figure 5:
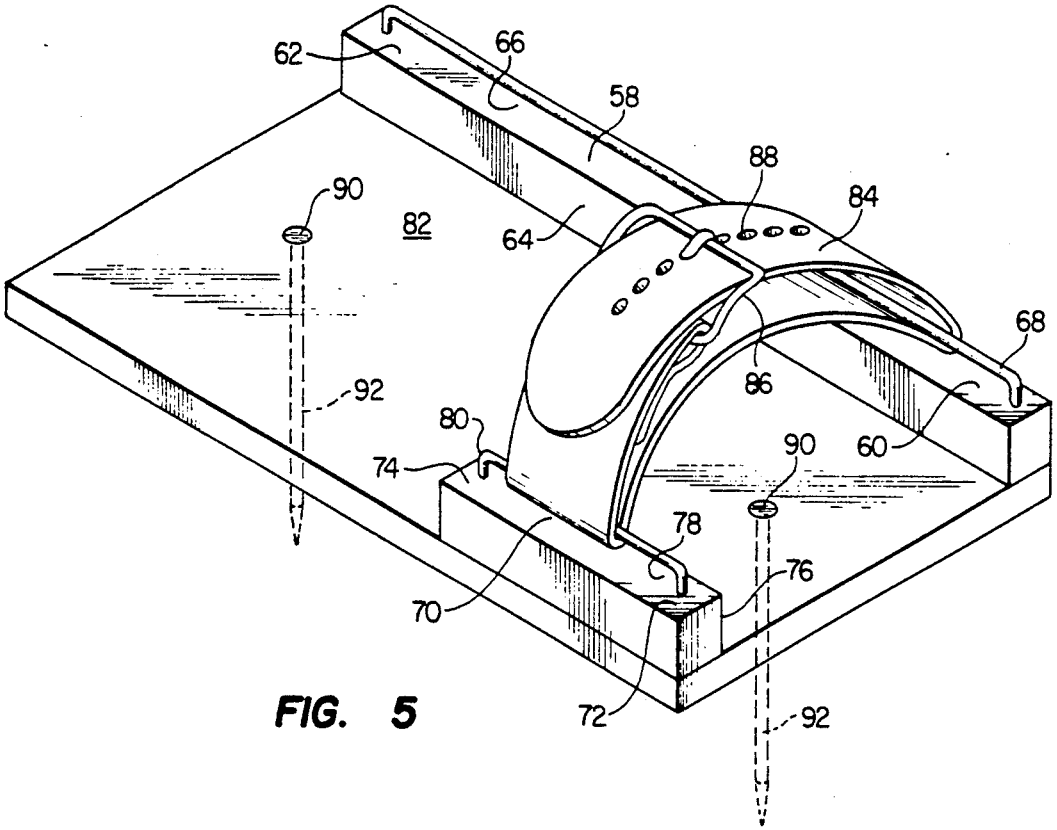
FIG. 5 is a perspective view showing an alternative embodiment having a belt-like connecting device and base members mounted on a pad.

An alternative embodiment is shown in FIG. 5. This embodiment is most suitable for a golfer wearing shoes without spikes. It has an outside base member 58, having a front end portion 60 and a rear end portion 62, separated by a contact surface 64 between the end portions for contact with the outside edge part of the golfer's shoe. It further includes a slot 66 formed by a strap support 68 which extends along the upper surface of the base member 58. Spaced a shoe width apart is an inside base member 70 having a front end portion 72 and a rear end portion 74 with a contact surface 76 extending between the end portions for contact with the inside edge part of the golfer's shoe. It has a slot 78 formed by a strap support 80 extending along the top surface of inside base member 70.

The base members are mounted a shoe width apart on the upper surface of a pad member 82. At least one of said base members may be adjustably mounted on said pad member laterally in order to accommodate shoes of different widths. Connecting device 84 is looped around the strap supports 68, 80 through the slots 66, 78 and secured with a buckle 86 lying on the upper surface to form a bridging support over the front portion of the golfer's shoe when the shoe is placed between the base members in the use position and connects a front portion of the outside base member with the inside base member. The long slot 66 allows the connecting device to slide along the support 68 to the rear end 62 thereof if the inside base member is removably connectable along the same edge at the opposite end portion 62, so that end portions 74 and 62 lie across from each other on pad member 82. This is not actually shown on the drawing, but is contemplated so that the same device could be usable for a left-handed golfer.

FIG. 5, as in all the figures, is arranged for use by a right-handed golfer. By placing the buckle in one of the support holes 88, the strap can be tightened to more snugly bridge the shoe. Finally, the pad member is equipped with one or more openings 90 through which is passed a ground-engaging removable spike 92 which will secure the pad member and the base members mounted thereto in position for use with the bottom of the pad resting on the surface of the ground.

Figure 6:
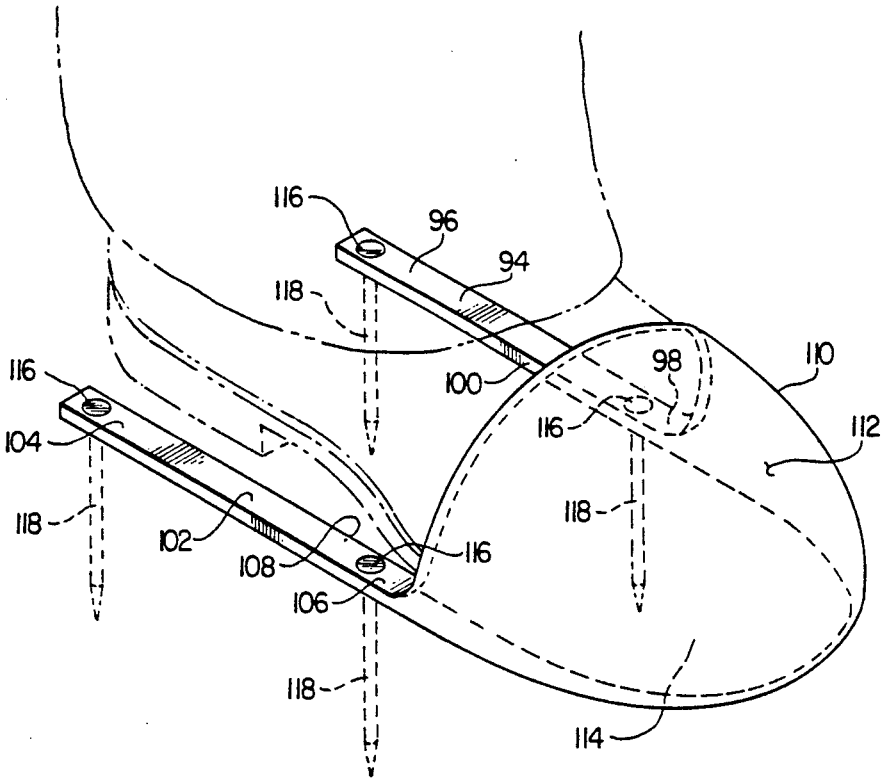
FIG. 6 is a perspective view showing an alternative embodiment having a toe receiving cup joining the base members.

FIG. 6 shows another alternative embodiment having an outside base member 94, having a front portion 98 and a rear end portion 96. Running between the end portions 96, 98 is a contact surface 100 for contacting the outside edge of the golfer's shoe. Spaced a shoe width apart is inside base member 102 having a rear end portion 104, a front end portion 106 and running there between a contact surface 108 for contacting the inside edge part of the golfer's shoe. A connecting device extends forward of the front ends of the base members and forms a connection between them. It has a downwardly curving surface which extends outwardly and downwardly from the front end portions of the base members to create a toe receiving cavity 114 in which the front portion of the golfer's shoe may be placed. The base members extend rearwardly from the toe receiving cavity in spaced apart parallel relation. Each of the base members includes a means for removably securing a base member to a ground surface comprising openings 116 for removable ground engaging spikes 118. Alternately, the rear end portions 96, 104 of the base members may have slotted portions and foldable legs as shown in FIGS. 2–4. The folded legs would fold under the ground engaging under surface of the base members back toward the front end portion. Further ground support can be provided by the ground engaging spikes at the front end portions of the base members.

In FIG. 7 is seen an outside base member 120 and a spaced apart inside base member 122. Outside base member 120 has a front end portion 124 and a rear end portion 126 having the offset slotted portion 36 for receiving foldable legs 12 and 14 foldably connected to the base member by pins 40. Wing nuts 42 may frictionally engage the offset upper end portions 38 of the foldable legs as before. Integrally formed between end portions of the outside base member is a slotted portion 128 to which is fixedly looped one end of a connecting device 44 which is held in place by retainer 54. Connecting device 44 is the same VELCRO strap described in relation to FIG. 2. Running between the front and rear end portions 124, 126 is a contact surface 129 above and below the slotted portion 128, and defining the slot, which serves as a contact for the outer edge part of a golfer's shoe when it is placed for use in the device.

Inside base member 122 has a front end portion 130 and a rear end portion 132 having offset slotted portions 36 for receiving the offset end portions 38 of foldable legs 16, 18 mounted in the slots by means of pins 40 and being frictionally engagable by wing nuts 42. Inside base member 122 has an integrally formed slotted portion 134 through which the free end 56 of the connecting device 44 is adjustably looped. A contact surface 136 running between the end portions above and below the slotted portion 134, and defining it, provides a contact surface for the inside edge of the golfer's shoe when placed in the use position between the base members. By holding the connecting member and sliding the outside base member so that the end of the connector member with the retainer looped around through the slotted portion 128 is moved to the opposite end of the base member 120, the device is instantly convertible from use for a right-handed golfer, as shown in FIG. 7, to use for a left-handed golfer.

Figure 9:
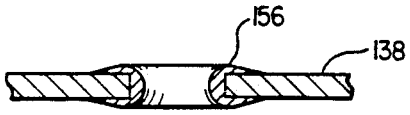
FIG. 9 is a cross-sectional view of a grommet in the mat which cooperates with a fastener to secure the base member to the mat.
Figure 8:
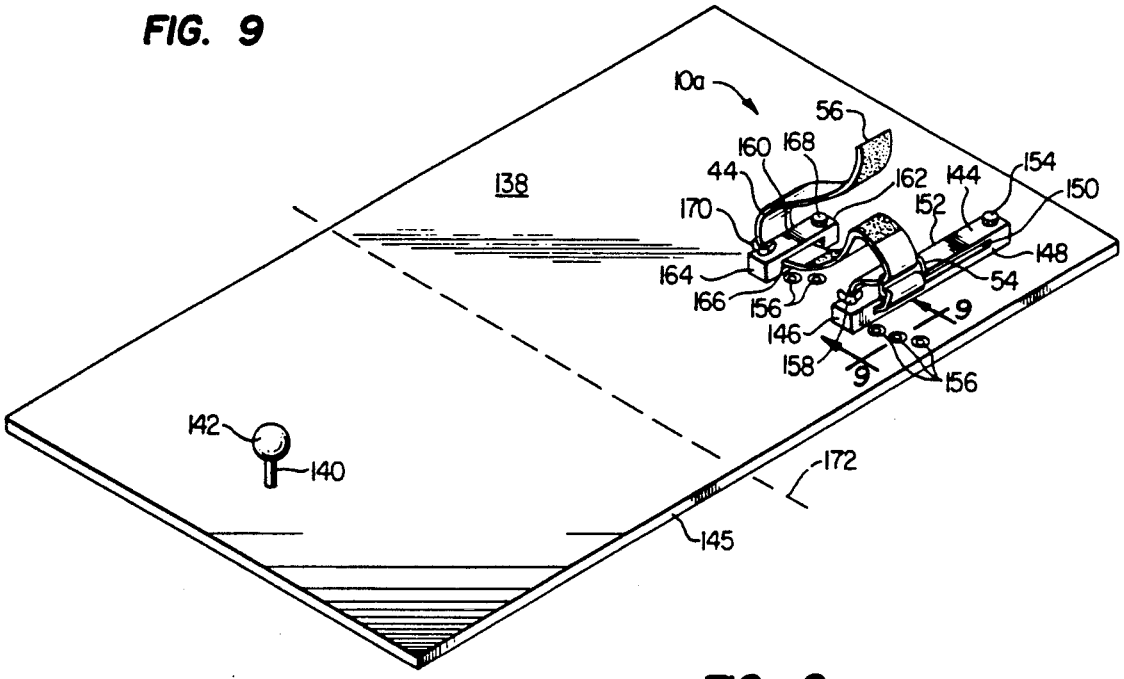
FIG. 8 is a perspective view of a mat having pivotally mounted base members having slotted portions and an adjustable strap and including a rubber tee and ball.

In FIG. 8 is an alternative embodiment of the golf aid mounted offset laterally and rearwardly on a mat 138. Mat 138 preferably has a rubber tee 140 mounted in the front portion thereof for supporting ball 142. Although mat 138 is portable, it is primarily designed for use at a particular location. Golfing device **10*a* is shown mounted at the left rear portion of the mat 138 with respect to the location of the tee and ball. Outside base member 144 is mounted closest to the outside edge 145 of mat 138. Member 144 has a front end portion 146 and a rear end portion 148. Running between the end portions 146, 148 is an integrally formed slotted portion 150 which has a contact edge 152 above and below slot 150 for contacting the outer edge portion of a golfer's shoe. The rear end portion 148 is pivotally mounted to the mat by a fastening means, such as bolt 154. Fixedly looped around through the slotted portion 150 is the end 56 of a connecting device 44 passed through the retainer 54 to form a looped end which is slidable along the length of the slot 150. Arranged along the radius from the bolt 154 are a plurality of grommets 156 in mat 138 which are shown in cross-section in FIG. 9. One of the grommets 156 is hidden from view under the end portion 146 of outside base member 144. An adjustably removable fastener 158 cooperates with the grommets 156 and the mat to adjustably mount the front end portion 146 of member 144 in parallel, or slightly angular position with respect to the longitudinal axis of the mat 138, which may be thought of as running equidistant from the edges through the tee 140 perpendicular to dotted line 172**.

Inside base member 160 is mounted to the mat spaced apart a shoe width from outside base member 144. It has rear end portion 162 separated from front end portion 164 by a slotted portion 166 running between the end portions. Slotted portion 166 is wider than the connecting device 44 which is adjustably received therethrough for adjustably bridging and snugly retaining the front or instep portion of a golfer's shoe.

Like outside member 144, inside base member 160 is mounted to the mat at the rear portion by means of a bolt 168 for pivotal attachment thereto. A plurality of radially arranged grommets 156, one of which is hidden under the front portion 164 are engaged by an adjustably removable fastener 170, so that inside base member 150 may also be angled with respect to the longitudinal axis of the mat. In use it would expected to be angled to roughly the same angle as member 144 so as to maintain rough spaced apart parallelity between the two base members. It is recognized that the spacing of the grommets necessarily must he different because the outside base member 144 is significantly longer than the inside base member 160, as shown, and therefore the radius between the bolt 168 and the grommets 156 is much shorter.

The golfer would be expected to stand on the mat 138 with the pivotal foot between the base members and bridged by the connecting device which can be tightened to snug over the shoe. The weight of the golfer with both feet on the mat prevents the mat from moving during manipulation of the golf club. Connecting device 44 is preferably a VELCRO strap and it may also be angled, because of the long slot length, at an angle with respect to the longitudinal axis of the golfer's foot. It might be suggested that the mat could be cut off or hinged at the dotted line 172, to fold back under, so that a golfer could choose to use a regular tee while still retaining the advantages of a comfortable mat to stand on while using the golfing aid. It should also be noted that several rubber tees 140 could be provided at different striking distances to accommodate golfer's with different club lengths or different sized swing arcs. Alternatively, golfing aid 10*a* could be provided with additional means for mounting in a more forward or more rearward position. The angulation of the golfing aid 10*a* by means of the pivotal mounting adjustment is to permit the golfer to select a slightly angled foot position so that he can comfortably approximate his preferred normal stance.

In the best mode, the mat is preferably made from an artificial turf-like material having a semi-flexible backing and is relatively non-absorbent. The base members are preferably molded from relatively rigid plastic and the depending legs and hardware are preferably metal. Although VELCRO is by far the preferred strap material because of its ease of strapping and unstrapping the foot, the strap of the connecting device could be made of a semi-flexible material like a leather belt shown in FIG. 5 or even a rubber strap.

I claim:

1. A golf aid for limiting and restricting a golfer's front shoe and foot from undesirable movement during the backswing and swing when the golfer's shoe and foot are placed in use position in the golf aid device on a ground surface, comprising:

an outside base member having front and rear end portions and a contact surface between the end portions for contact with the outside edge part of a golfer's shoe;

an inside base member having front and rear end portions and a contact surface between the end portions for contact with the inside edge part of said golfer's shoe;

a connecting device bridgeable over the front portion of said golfer's shoe when said shoe is placed between the spaced apart base members in use position with the contact surfaces proximate the edge parts of the golfer's shoe, said connecting device connecting a front portion of the outside base member with the inside base member; and means for removably securing the inside and outside base members to a ground surface in an adjustably spaced apart relationship to each other so that said golfer's aid will tend to prevent the golfer's front foot from lifting and turning or pivoting during the swing to condition the golfer to keep the front foot planted during his swing.

2. The golf aid of claim 1 wherein the inside and outside base members are elongate bars.

3. The device of claim 2 wherein the connecting device is an adjustable strap of sufficient length to bridge the instep of different size golf shoes and permit variation in lateral spacing of the base members.

4. The device of claim 3 wherein the means for removably securing the base members comprise foldable legs attached to the opposite end portions.

5. The device of claim 3 wherein at least one of the base members has a slotted portion for connecting the strap by looping the strap through the slot in said base member.

6. The golf aid of claim 5 wherein the slotted portion in integrally formed in the body of said at least one base member.

7. The golf aid of claim 5 wherein the slotted portion is formed by separately attaching a strap support to said at least one base member.

8. The golf aid of claim 5 wherein the slotted portion is sufficiently longer than the width of the strap to permit angling the strap across the instep of a golfer's shoe.

9. The device of claim 8 wherein said at least one base member is the outside base member which is longer than the inside base member.

10. The golf aid of claim 9 wherein said adjustable strap includes mating hooks and loops and said strap is fixedly looped around one of said inside or outside base members and adjustably looped around the other.

11. The device of claim 9 wherein said adjustable strap is a belt-like strap which is looped through the slotted portion of each base member and buckled.

12. A golf aid for limiting and restraining a golfer's shoe and foot from undesirable movement during the backswing and swing when the golfer's shoe and foot are placed in use position in the golf aid device on a ground surface, comprising:

an outside base member having front and rear end portions and a contact surface between the end portions for contact with the outside edge part of a golfer's shoe;

an inside base member having front and rear end portions and a contact surface between the end portions for contact with the inside edge part of said golfer's shoe;

a pad member to which the laterally spaced apart and aligned based members are mounted with their shoe contact surfaces a shoe width apart; and a connecting device bridgeable over the front portion of said golfer's shoe when said shoe is placed on the pad between the base members in use position, and connecting the front portion of said inside and outside base members, said connecting device including means for slidably connecting one end thereof to said outside base member to permit adjusting said one end lengthwise thereof to permit angling the strap across the instep of a golfer's shoe.

13. The golf aid of claim 12 wherein said inside and outside base members are elongate bars and said connecting device is a flexible, extensible strap.

14. The device of claim 12 wherein the inside and outside base members are elongate bars having a slotted portion and said connecting device is an adjustable strap connected to said base members by looping through said slotted portions and having a releasable fastener means.

15. The golfing aid of claim 14 wherein the outside bar is significantly longer than the inside bar and has a slotted portion of sufficient length to permit frontward and rearward movement of the connection between the adjustable strap and the slotted portion of the outside bar.

16. The device of claim 15 further including means for releasably securing the pad member to a ground surface in position for use.

17. The combination of claim 15 wherein at least one of said base members are adjustably mounted on the pad member to accommodate shoes of different width.

18. A golf aid for limiting and restraining the golfer's shoe and foot from undesirable movement during the backswing and forward swing when the golfer's shoe and foot are placed in use position in the golf aid device when it is resting on a ground surface, comprising:

a mat of sufficient size to accommodate both a golfer and a normally located tee in front of the golfer;

an upstanding outside base member securably mounted on the mat;

an upstanding inside base member securably mounted on the mat a golf shoe width from said outside base member; and a connecting device mounted over the base members and adjustably fixed to bridge the front portion of said golfer's shoe when it is placed between the base members in position for use, wherein said golfer's aid will tend to prevent the golfer's foot from lifting and turning or pivoting during the backswing or forward swing when the golfer is standing on the mat and executing a golf club swing at a ball on said tee.

19. The device of claim 18 wherein at least one of said base members is adjustably mounted on the mat.

20. The golfing aid of claim 19 wherein said adjustable mounting includes pivotal adjustment to permit variation in foot angle with respect to the line of flight.

21. The device of claim 20 wherein each of the base members is pivotally mounted on the mat at one end and adjustably mountable at the other end by means of fasteners which cooperate with the mat.

22. The device of claim 18 wherein at least one of the base members has a slotted portion for connecting the strap by looping the strap through the slot in said base member.

23. The golf aid of claim 22 wherein the slotted portion is integrally formed in the body of said at least one base member.

24. The golf aid of claim 23 wherein the slotted portion is formed by separately attaching a strap support to said at least one base member.

25. The golf aid of claim 22 wherein the slotted portion is sufficiently longer than the width of the strap to permit angling the strap across the instep of a golfer's shoe.

26. The device of claim 25 wherein said at least one base member is the outside base member which is longer than the inside base member.

27. The golf aid of claim 26 wherein said adjustable strap includes mating hooks and loops and said strap is fixedly looped around one of said inside or outside base members and adjustably looped around the others.

28. The device of claim 27 wherein said adjustable strap is a belt-like strap which is looped through the slotted portion of each base member and buckled.

* * * * *